United States Patent [19]

Mason et al.

[11] Patent Number: 4,718,258

[45] Date of Patent: Jan. 12, 1988

[54] REVERSING DRIVE FOR TRIPLE ACTION AGITATOR

[75] Inventors: Anthony Mason; Victor W. Cuthbert, both of Lincoln Township, Berrien County, Mich.

[73] Assignee: Whirlpool Corporation, Benton Harbor, Mich.

[21] Appl. No.: 848,936

[22] Filed: Apr. 7, 1986

[51] Int. Cl.[4] ..... D06F 17/08

[52] U.S. Cl. ..... 68/133; 68/23.6; 74/20; 74/21

[58] Field of Search ..... 68/131, 133, 23.6; 74/20, 21, 22 R

[56] References Cited

U.S. PATENT DOCUMENTS

| | | | |
|---|---|---|---|
| 60,952 | 1/1867 | Sperry | 74/20 |
| 1,220,838 | 3/1917 | George | 74/20 |
| 3,678,714 | 7/1972 | Krolzick . | |
| 3,798,984 | 3/1974 | McMinn | 74/20 |
| 3,987,508 | 10/1976 | Platt . | |
| 3,987,651 | 10/1976 | Platt . | |
| 3,987,652 | 10/1976 | Ruble . | |
| 4,155,228 | 5/1979 | Burgener, Jr. et al. . | |
| 4,164,130 | 8/1979 | Hammer . | |
| 4,452,054 | 6/1984 | Hafstrom . | |
| 4,520,638 | 6/1985 | Brenner . | |

*Primary Examiner*—Harvey C. Hornsby
*Assistant Examiner*—Frankie L. Stinson
*Attorney, Agent, or Firm*—Hill, Van Santen, Steadman & Simpson

[57] ABSTRACT

A reversing drive for a triple action agitator is provided in which the agitator has an upper portion with helical grooves formed therein and a thruster barrel is received over the agitator upper portion. The thruster barrel has inwardly directed pegs which cammingly ride in the grooves to provide vertical movement to the thruster relative to the agitator. A two position clutch has an alternating rachet-type engagement between the agitator and the thruster to prevent rotary motion between the thruster and agitator when the agitator is rotating in a first direction, but to permit rotary motion between the thruster and agitator when the agitator is rotating in a second direction when the clutch is in a first position. When the clutch is in the second position, relative rotary motion is permitted when the agitator is rotating in the first direction and is prevented when the agitator is rotating in the second direction.

11 Claims, 7 Drawing Figures

REVERSING DRIVE FOR TRIPLE ACTION AGITATOR

BACKGROUND OF THE INVENTION

1. Field of the Invention

This invention relates to an automatic washing machine agitator construction and more specifically to an agitator construction wherein the agitator is comprised of an oscillatory rotating lower portion and a vertically reciprocating and an oscillatory rotating upper portion.

2. Description of the Prior Art

A number of different types of agitating structures are disclosed in the prior art for automatic washing machines which provide both reciprocatory and rotary movement of an agitator. For example, U.S. Pat. Nos. 3,678,714, 4,452,054 and 4,520,638 all disclose upper agitator portions which are driven in a reciprocating vertical motion by the oscillatory motion of the agitator shaft.

U.S. Pat. No. 4,520,638 discloses an agitator thruster for an automatic washer for increasing the rollover of clothes during the agitation portion of a washing cycle wherein the thruster moves in a vertical reciprocating motion by action of a pin carried by the thruster engaging angled side walls of a channel in the agitator barrel and being caused to move in one direction around the channel circuit, up along one angled channel wall and down along another.

U.S. Pat. No. 4,452,054 discloses an agitator thruster for an automatic washer for increasing the rollover of clothes during the agitation portion of a washing cycle wherein the thruster moves in a vertical reciprocating motion by using inner and outer reversely spiraled cam surfaces and a driving barrel having a driving pin which alternately transfers to the inner and outer cam surfaces.

U.S. Pat. No. 3,678,714 discloses a washing machine assembly of the vertical axis type, including an agitator assembly which oscillates about a stationary vertical axis, in combination with a second agitator which is coupled to the main agitator for oscillation therewith, together with means operating between the main agitator and the other agitator to effect a vertical reciprocation of the latter during oscillation.

SUMMARY OF THE INVENTION

The purpose of the present invention is to provide both vertical reciprocating and rotary oscillating motion to an upper portion or thruster of an agitator barrel to provide an improved washing action by increasing the rollover of the articles to be washed. The agitator of the present invention is particularly designed for those types of washing machines which include a perforate basket assembly connected to a vertically disposed shaft, with an oscillating agitator being disposed in the perforate basket having a shaft concentric with the shaft which rotates with the perforate basket. Drive means are provided to selectively rotatingly drive the perforate basket continuously in a wash liquid extraction stage, and to oscillate the agitator vanes during the washing cycle.

In accordance with the present invention, a secondary agitator or thruster provides vertical and oscillatory movement in the wash liquid during agitation. The preferred form of the invention involves the use of a switchable one-way clutch mechanism which, when in a first position, causes the upper portion of the agitator barrel to be incrementally rotated in a first direction each time the base portion of the agitator rotates in a first direction. The clutch permits a rotary slippage between the thruster and the lower agitator as the lower agitator rotates in a second direction during which time the thruster is incrementally moved upwards.

Once the agitator barrel has moved to its uppermost position, the clutch is caused to switch to its second position, which causes the upper agitator barrel to be incrementally rotated in a second, opposite direction each time the lower portion of the agitator moves in a second direction and be driven incrementally downward during a slippage between the thruster and the lower agitator as the lower agitator rotates in the first direction. The clutch mechanism includes an integral over-center spring which bias the clutch to either its first or second position. The clutch is moved between positions by pegs carried on the thruster. The thruster is guided by cam pegs carried on the thruster which engage in helical grooves in the lower agitator barrel.

The rate at which the upper agitator barrel oscillates and reciprocates is determined by the length and inclination of the helical grooves on the lower agitator barrel and by the stroke rate and stroke length at which the lower agitator portion is driven. While this type of mechanism can be used with automatic washers providing a variety of stroke rates and stroke angles, the agitator is particularly well suited for use in washing machines which utilize a high stroke rate and a short stroke. By way of example, this agitator provides a very effective washing action in washing machines having a stroke rate of 180 strokes per minute and a stroke angle of 100°.

DESCRIPTION OF THE PREFERRED EMBODIMENT

Figure 1:
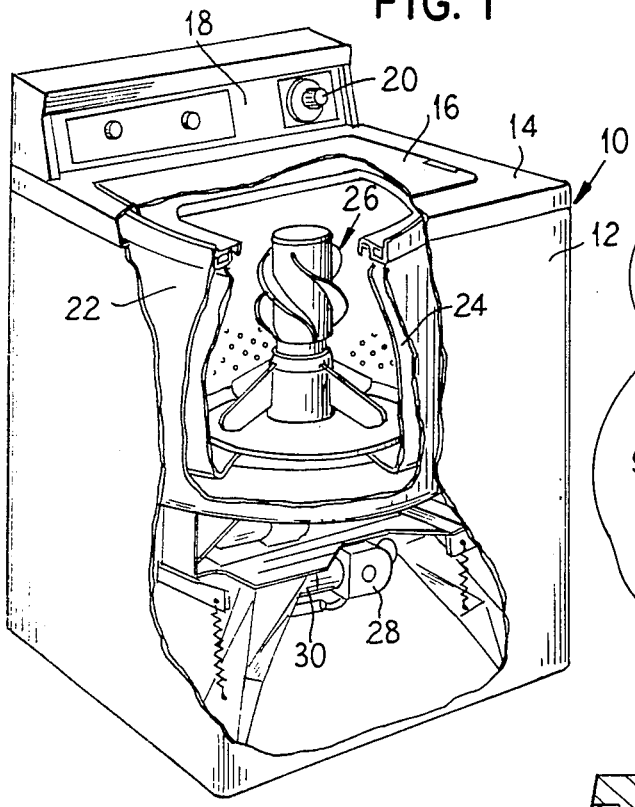
FIG. 1 is a perspective view of a washing machine embodying the present invention, partially cut-away to show the interior mechanism thereof.

A laundry appliance 10 comprising an automatic clothes washer embodying the principles of the present invention is depicted in FIG. 1. The washer is comprised of a cabinet 12 having top 14 with a lid 16 and a console 18 having presettable controls 20 thereon of the type wherein an operator may preselect a program of automatic washing, rinsing and drying steps in a laundering process. The lid 16 in the top 14 of the cabinet 12 permits access into the top of a tub 22 housed within the cabinet 12. Enclosed and supported within the tub 22 is a clothes container or spin basket 24 within which is oscillatably mounted an agitator 26.

Figure 2:
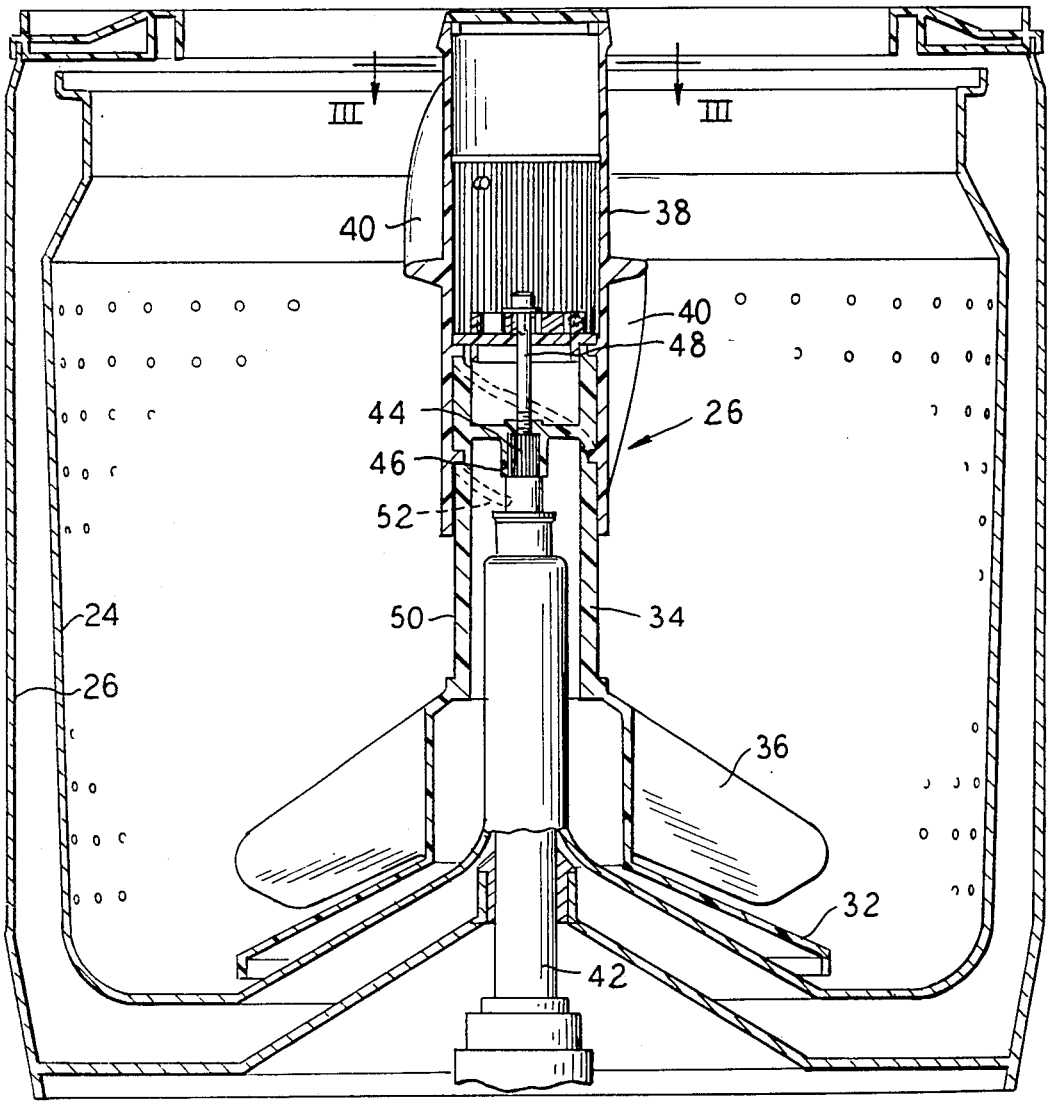
FIG. 2 is a side sectional view of the agitator assembly within the tub and basket of the washing machine.

Below the tub 22 but within the cabinet 12 there is provided an electric motor 28 which oscillatably drives the agitator 26 through a transmission 30. The agitator 26 is shown in greater detail in FIG. 2 where is is seen that the agitator 26 is comprised of a skirt portion 32 near the bottom of the agitator and a substantially vertical barrel portion 34 integrally connected with the skirt and projecting upwardly therefrom. A plurality of pumping vanes 36 are provided around the periphery of the barrel 34 and extend downwardly and outwardly along the skirt portion 32 of the agitator 26.

A thruster portion 38 of the agitator is mounted concentrically about the barrel portion 34 and above the pumping vanes 36. The thruster portion 38 has a plurality of thrusting vanes 40 provided around the periphery of the thruster 38.

A drive shaft 42 for the agitator extends upwardly through the barrel portion 34 of the agitator and is drivingly connected to the barrel portion by means of a splined end 44 meetingly engaging a conversely shaped opening 46 in the barrel 34. Fastening means 48 such as a screw retains the splined connecting portions in a fixed axial relationship. Thus, oscillation of the drive shaft 42 oscillates the barrel 34 via the spline connections 44, 46 on the barrel drive shaft 42 and the barrel 34.

Figure 6:
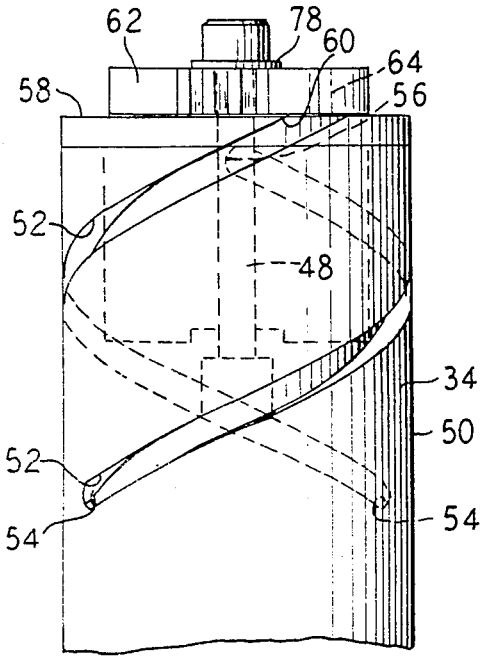
FIG. 6 is a side elevational view of the lower agitator body.

On an outer surface 50 of the barrel 34 is provided a pair of recessed helical grooves 52 shown in greater detail in FIG. 6. The grooves 52 extend around the outer surface 50 of the agitator barrel 30 both horizontally and vertically at a predetermined slope.

Both of the grooves 52 have a bottom end 54 which is a blind end or stop. One of the grooves 52 has a top end 56 which is also a blind end stopping short of a top end 58 of the barrel 34. The second of the grooves 52 has a top end 60 which opens through the top end 58 of the barrel 34.

Figure 5:
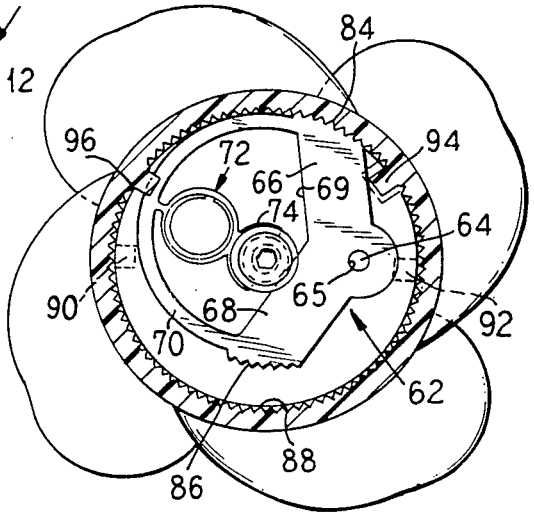
FIG. 5 is a view substantially similar to FIG. 3 showing the clutch in a second driving position.
Figure 3:
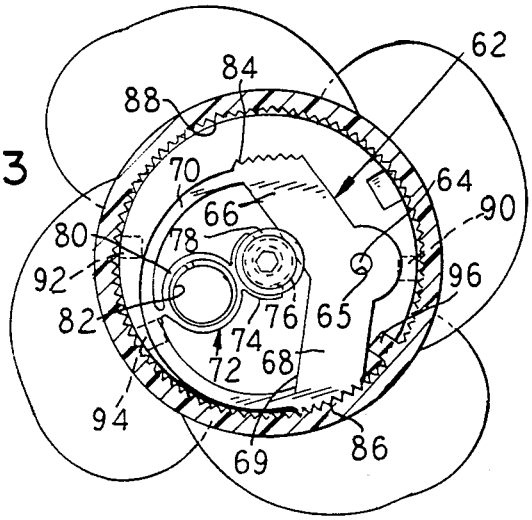
FIG. 3 is a top sectional view through the agitator taken generally along the lines III—III of FIG. 2 showing the clutch in a first driving position.
Figure 4:
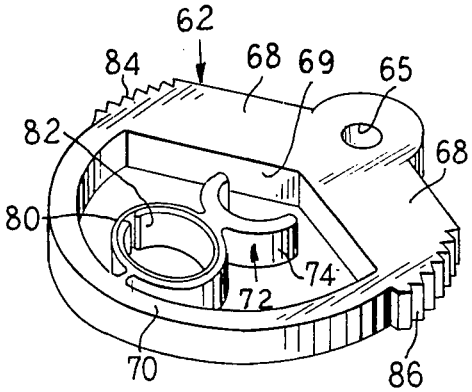
FIG. 4 is a perspective view of the clutch and over-center spring seen in FIG. 3.

Pivotally mounted above the top end 58 of the agitator barrel 34 is a clutch 62. The pivotal mounting is accomplished by means of a pivot pin 64 extending above the top end 58 of the barrel 34. The pivot pin 64 is mounted in an off-center position on the barrel 34 and is received in an opening 65 in the clutch. The clutch is shown in FIGS. 3, 4 and 5 and it is seen that the clutch has two laterally extending arms 66, 68 extending away from the pivot pin 64 like the upper arms of a Y and defining a V-shaped wall 69. An arcuate wall 70 connects the outward ends of the arms 66, 68.

A radially inwardly projecting arm 72 extends from the arcuate wall 70 opposite the pivot pin opening 65. An end of the arm 72 has a U-shaped member 74 which slidingly engages a cylindrical boss 76 extending upwardly from the top surface 58 of the barrel 34. The retaining screw 48 extends through the boss and carries a washer 78 which overlies the U-shaped member 74 to prevent it from being vertically disengaged from the boss 76. Between the U-shaped member 74 and the arcuate wall 70 is a spring member 80 which may have the form of an open circle and which may include a separate metallic split cylinder spring 82. The outer edges of the arms 66, 68 have projecting teeth 84, 86.

Figure 7:
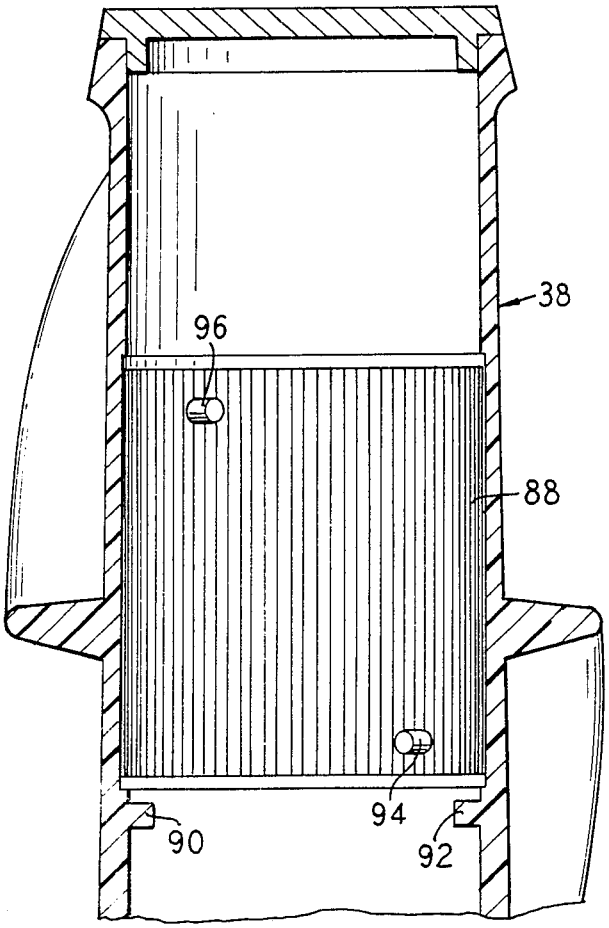
FIG. 7 is a side sectional view of the upper agitator portion.

The thruster 38 is shown in greater detail and in section in FIG. 7 and it is seen that a portion of the interior diameter of the thruster has an interior splined section 88 extending around the entire interior perimeter of the thruster, also visible in FIGS. 3 and 5, which appears as inwardly directed teeth. The interior splined section 88 is alternately engagable by the teeth 84, 86 of the clutch member 62 to provide a rachet-type connection between the clutch 62 and the thruster 38.

The thruster 38 carries four inwardly projecting pegs 90, 92, 94 and 96. The first two pegs 90, 92 are spaced at a common height in the thruster 38 and are positioned diametrically opposite one another. The second two pegs 94, 96 are spaced above the first two pegs 90, 92 and are spaced vertically apart from one another corresponding to the vertical length of travel of the thruster and corresponding to the vertical height of the helical grooves 52. The second two pegs 94, 96 are angularly spaced about the interior perimeter of the thruster at an angle equal to the angle that the helical grooves 52 extend around the outer circumference of the agitator barrel 34.

In operation, the lower two opposed pegs 90, 92 are received in the slots 52 in the agitator barrel 34 and cause the thruster 38 to move relative to the agitator barrel 34 in a manner defined by the shape of the grooves 52 due to a camming engagement between the pegs 90, 92 and the grooves 52. The upper two pegs 94, 96 are used to shift the clutch 62 between two over-center positions as shown in FIGS. 3 and 5. When the thruster 38 is in its lowest position relative to the agitator 34, the upper peg 96 will engage one arm 68 of the clutch 62 as is illustrated in FIG. 3 and the peg 96 will urge the teeth 86 away from the splined portion 88 sufficiently far so that the clutch member will be pushed beyond the center position at which time the spring will cause the clutch to snap to the opposite position shown in FIG. 5. At this point, the teeth 84 on the end of arm 66 will engage the splined portion 88 and the wall 69 of the arm 68 will engage the boss 76. The engagement of the teeth 84 against the splined portion 88 will act as a ratchet permitting the agitator barrel 34 to drive thruster 38 in a counter-clockwise direction. As viewed from the top of the agitator downward as in FIG. 5, clockwise movement of the barrel 34 will permit relative motion between the barrel and thruster by the disengagement of the teeth 84 from the splined portion 88.

The clothes within the washer will provide a sufficient drag on the thruster 38 such that, in effect, the thruster 38 will be held in a rotatingly stationary position relative to the wash basket 24 while the bottom portion of the agitator 26 moves in a clockwise rotary motion. During this time, the camming action of the helical grooves 52 against the pegs 90, 92 will cause the thruster 88 to move vertically upwardly. As the bottom portion of the agitator begins to move in a counter-clockwise direction, the teeth 84 will be held in an engagement with the splined portion 88 and the thruster 38 will move with the agitator 26. When the agitator again returns to counter-clockwise movement, again, the clothes will hold the thruster portion 38 rotationally stationary and the teeth 84 will slide on the splined portion 88 permitting relative movement between the thruster 38 and the agitator barrel 34.

This action will continue until the lower of the upper two pegs, 94, which moves along one of the helical grooves 52, is carried above the top 58 of the agitator barrel 34 to engage the arm 66 of the clutch 62 as is illustrated in FIG. 5. Continued movement of the peg 94 against the arm 66 causes the clutch 62 to snap into the opposite position shown in FIG. 3 so that the teeth 86 on the end of the arm 68 will engage the splined portion 88 and the wall 69 of the arm 66 will engage the boss 76. When this occurs, the thruster will be at the uppermost position of its travel and its movement will be reversed. That is, now as the agitator moves in the clockwise direction the teeth 86 will be pressed into engagement with the splined portion 88 and will prevent the thruster 38 from moving relative to the barrel portion 34.

As the agitator oscillates in a counter-clockwise direction of movement, the clothes load will hold the thruster rotatingly stationary and the teeth 86 will disengage from the splined portion 88 permitting the agitator barrel 34 to rotate relative to the thruster portion 38. The movement of the helical grooves 52 relative to the pegs 90, 92 will cause the thruster 38 to be moved downwardly during the relative movement. As the agitator oscillates back to a clockwise movement, the thruster 38 will again be rotatingly carried with the agitator so that it will rotate, but remain vertically stationary.

Thus, it is seen that the present invention provides an agitator in which the lower portion has rotating oscillatory motion and the upper portion alternatively rotates in one direction and moves vertically in one direction for a preselected period of time until the two directions are reversed, that is, the rotating motion and vertical motion are reversed thus providing the oscillatory and reciprocatory motion of the thruster.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention is which an exclusive property or privilege is claimed are defined as follows:

1. A means for converting oscillatory rotary motion into vertical reciprocating and oscillatory rotary motion comprising:

a rotationally oscillating drive barrel;

a thruster barrel rotatably and reciprocably mounted on said drive barrel;

means for selectively preventing rotary motion between said thruster barrel and said drive barrel comprising a two position clutch means selectively engagable between said thruster barrel and said drive barrel to prevent rotary motion between said two barrels when said drive barrel is rotating in a first direction, but to permit rotary motion between said two barrels when said drive barrel is rotating in a second, opposite direction with said clutch means in a first position and when said clutch means is in its second position, rotary motion between said two barrels is permitted when said drive barrel is rotating in said first direction and is prevented when said drive barrel is rotating in said second direction;

peg means projecting radially from one of said barrels toward the other;

recessed channel means formed in the surface of the other of said barrels to receive said peg means; said channel means comprising a helical groove;

whereby, relative rotational movement between said barrels will cause said peg means to move in said grooves causing said thruster barrel to reciprocate.

2. A device according to claim 1, wherein said clutch means comprises a pivotable clutch member mounted on said drive barrel being pivotable between two positions to selectively engage said thruster barrel with different portions of said clutch member.

3. A device according to claim 2, wherein said thruster barrel has an internally splined portion engagable by said clutch member and said clutch member has outwardly directed teeth on the portions thereof engagable with said thruster barrel splined portion such that said teeth and said spline portion have a rachet-type engagement selectively permitting and preventing relative rotational movement between said two barrels.

4. A device according to claim 2, wherein two inwardly projecting pegs are carried on said thruster barrel, vertically and angularly spaced apart to alternately engage said clutch member and urge it into said positions.

5. A device according to claim 4, wherein said clutch means includes an over-center spring which biases said clutch member into the selected one of said two positions until one of said pegs engages and urges said clutch member into the other of said positions.

6. In an automatic washer having a basket for receiving clothes to be washed, an agitator means within said basket for agitating the clothes during a wash cycle, said agitator means including an upper portion, and motor means drivingly connected to said agitator, a secondary agitation means mounted on said agitator for enhancing rollover of said clothes in said basket during agitation, said secondary agitation means comprising:

a driven thruster barrel surrounding said upper portion of said agitator, said driven barrel having vane means on an exterior portion for forcing clothes downwardly along said upper portion of said agitator, said driven barrel further provided with inwardly projecting pegs;

said upper portion of said agitator barrel containing a recessed area for receiving said pegs, said recessed area comprising helical grooves extending vertically and angularly around the exterior of said upper portion of said agitator;

a clutch means selectively engagable between said thruster barrel and said drive barrel to prevent rotary motion between said two barrels when said drive barrel is rotating in a first direction, but to permit rotary motion between said two barrels when said drive barrel is rotating in a second, opposite direction with said clutch means in a first engaged position and with said clutch means in a second engaged position, rotary motion between said two barrels is permitted when said drive barrel is rotating in said first direction and is prevented when said drive barrel is rotating in said second direction;

whereby, relative rotational movement between said barrels will cause said pegs to move in grooves causing said thruster barrel to vertically reciprocate.

7. A device according to claim 6, wherein said clutch means comprises a pivotable clutch member mounted on said drive barrel being pivotable between two positions to selectively engage said thruster barrel with different portions of said clutch member.

8. A device according to claim 7, wherein said thruster barrel has an internally splined portion engagable by said clutch member and said clutch member has outwardly directed teeth on the portions thereof engagable with said thruster barrel splined portion such that said teeth and said spline portion have a rachet-type engagement selectively permitting and preventing relative rotational movement between said two barrels.

9. A device according to claim 7, wherein two inwardly projecting shift pegs are carried on said thruster barrel, vertically and angularly spaced apart to alternately engage said clutch member and alternately urge it into said two positions.

10. A device according to claim 9, wherein said clutch means includes an over-center spring which biases said clutch member into a selected one of said two positions until one of said shift pegs engages and urges said clutch member into the other of said positions.

11. In an automatic washer having a basket for receiving clothes to be washed, an agitator means within said basket for agitating the clothes during a wash cycle, said agitator means including an upper portion, and motor means drivingly connected to said agitator, a secondary agitation means mounted on said agitator for enhancing rollover of said clothes in said basket during agitation, said secondary agitation means comprising:

a driven thruster barrel surrounding said upper portion of said agitator;

said driven barrel having vane means on an exterior portion for forcing clothes downwardly along said upper portion of said agitator;

said driven barrel further provided with inwardly projecting pegs;

said driven barrel still further having an internally splined portion extending around the entire periphery of said driven barrel;

said upper portion of said agitator barrel containing a recessed area for receiving said pegs, said recessed area comprising helical grooves extending vertically and angularly around the exterior of said upper portion of said agitator;

a clutch means including a clutch member mounted on said drive barrel and being pivotable between two positions to selectively engage said thruster barrel; said clutch member having two opposed arms with outwardly directed teeth to selectively engage with said splined portion of said driven barrel to prevent rotary motion between said two barrels when said drive barrel is rotating in a first direction, but to permit rotary motion between said two barrels when said drive barrel is rotating in a second, opposite direction with said clutch member in a first engaged position, and with said clutch member in a second engaged position, and with said clutch member in a second engaged position, rotary motion between said two barrels is permitted when said drive barrel is rotating in said first direction and is prevented when said drive barrel is rotating in said second direction;

two inwardly projecting shift pegs carried on said driven barrel, vertically and angularly spaced apart to alternatively engage said clutch member and alternatively urge it into said two positions; and an over-center spring to bias said clutch member into a selected one of said two positions until one of said shift pegs engages and urges said clutch member into the other of said positions.

* * * * *